US007137792B2

(12) United States Patent
Rosenauer et al.

(10) Patent No.: US 7,137,792 B2
(45) Date of Patent: Nov. 21, 2006

(54) PISTON PUMP FOR HIGH VISCOUS MATERIALS

(75) Inventors: Otto Rosenauer, Langenargen (DE); Karsten Juterbock, Wangen (DE); Johann Bertsche, Radolfzell (DE)

(73) Assignee: J. Wagner GmbH, Markdorf (DE)

( * ) Notice: Subject to any disclaimer, the term of this patent is extended or adjusted under 35 U.S.C. 154(b) by 358 days.

(21) Appl. No.: 10/629,317

(22) Filed: Jul. 29, 2003

(65) Prior Publication Data

US 2004/0050961 A1 Mar. 18, 2004

(30) Foreign Application Priority Data

Aug. 1, 2002 (DE) ..... 102 35 140

(51) Int. Cl.
*F04B 17/06* (2006.01)

(52) U.S. Cl. ..... 417/415

(58) Field of Classification Search ..... 417/554, 417/545, 552, 553, 555.1, 415, 416, 417, 417/437

See application file for complete search history.

(56) References Cited

U.S. PATENT DOCUMENTS

| | | | | |
|---|---|---|---|---|
| 1,065,709 | A * | 6/1913 | Myers | 417/440 |
| 1,543,087 | A * | 6/1925 | Baker | 417/554 |
| 2,281,899 | A * | 5/1942 | White | 417/530 |
| 2,730,957 | A * | 1/1956 | Riede | 417/569 |
| 2,841,086 | A * | 7/1958 | Deitrickson | 417/403 |
| 3,164,102 | A * | 1/1965 | Schmidt | 417/383 |
| 3,330,217 | A | 7/1967 | Baur et al. | |
| 3,827,339 | A * | 8/1974 | Rosen et al. | 92/152 |
| 4,087,209 | A | 5/1978 | Mahig et al. | |
| 5,080,565 | A * | 1/1992 | Schultz et al. | 417/550 |
| 5,228,842 | A | 7/1993 | Guebeli et al. | |
| 6,193,476 | B1 * | 2/2001 | Sweeney | 417/401 |
| 6,193,482 | B1 * | 2/2001 | Chen | 417/549 |
| 6,267,569 | B1 * | 7/2001 | Alaze | 417/470 |

FOREIGN PATENT DOCUMENTS

| | | |
|---|---|---|
| DE | 37 10 172 | 10/1988 |
| DE | 692 23 245 | 2/1993 |
| WO | WO 95/07412 | 3/1995 |

* cited by examiner

*Primary Examiner*—Anthony D. Stashick
*Assistant Examiner*—Samuel E. Belt
(74) *Attorney, Agent, or Firm*—Pandiscio & Pandiscio

(57) ABSTRACT

In a piston pump (1) having a differential piston (12) positioned in a cylindrical housing (11) and translationally drivable, a first pressure chamber (13) of the differential piston (12) is connectable to a second pressure chamber (14) via a check valve (16) inserted into a connecting line (15), and to a storage reservoir (2) via an inlet valve (23). The differential piston (12) is provided with a dipping piston (41) attached to a piston rod (31). In addition, a pass-through (32) of the piston rod (31) from the first pressure chamber (13) is closed fluid-tight by seals (34), and a transport line (22) is positioned laterally offset from or concentric to the piston rod (31) in the vicinity of the pass-through (32) of the latter.

10 Claims, 3 Drawing Sheets

PISTON PUMP FOR HIGH VISCOUS MATERIALS

CROSS-REFERENCE TO RELATED APPLICATION

This application claims the benefit of German Patent Application 102 35 140.6-15, filed on Aug. 1, 2002, the entire contents of which are hereby incorporated by reference.

FIELD OF THE INVENTION

The invention relates to a piston pump, in particular for transporting highly viscous media from a storage reservoir to an implement, for example a spray gun, having a differential piston disposed in a cylindrical housing and translationally drivable, whose first pressure chamber is connectable with the second chamber via a check valve inserted into a connecting line, and with the supply reservoir via an inlet valve inserted into a transport line.

BACKGROUND OF THE INVENTION

In a piston pump of this type manufactured by J. Wagner GmbH, Markdorf, Germany, under the designation HC 12000G, there is an inlet valve upline from the differential piston having a ball as its valve gate, which is opened during a suction motion of the differential piston, so that the medium to be processed is drawn into the first pressure chamber. At the same time, the medium located in the second pressure chamber is fed to the implement, and the second pressure chamber is filled again by medium flowing from the first pressure chamber. Thus continuous transport is provided during both displacement motions of the differential piston.

Although operating pressures up to 230 bar can be produced with this piston pump, the inlet valve sometimes does not close the first pressure chamber reliably during a displacement motion in the direction of the inlet valve, so that medium is pushed back into the storage reservoir. But it is particularly disadvantageous that when viscous media are processed, the first pressure chamber is often not completely filled during an intake stroke. As a result, the flow to the implement is not constant, and brief interruptions occur, so that the delivery flow may possibly break off and/or layers of varying thickness may be applied. Air pockets may also form in the medium, which have an undesirable effect on the processing of the medium.

OBJECTS OF THE INVENTION

The object of the invention is therefore to design a piston pump in such a way that the first pressure chamber of the differential piston is always completely filled with the medium to be processed, so that a continuous stream of spray and uniform application of the medium to be processed are ensured. In addition, there should be assurance that no air pockets are formed, and that a high operating pressure is maintainable even with long feed lines. Production cost of the piston pump should be kept at a minimum, yet uniformly good processing even of highly viscous media should be made possible for a long period of time.

SUMMARY OF THE INVENTION

This is accomplished according to the invention with a piston pump, as described herein, by the fact that the differential piston is provided with a dipping piston that is immersed in the medium to be transported, attached to an aligned, protruding piston rod; that the pass-through for the piston rod from the first pressure chamber is tightly sealed by one or more, preferably stretchable, seals; and that the transport line in the area of the pass-through for the piston rod is offset to the side or positioned concentrically to the latter.

It is preferable here to provide the pass-through for the piston rod and segments of the transport line in a connecting piece that is joined with the differential piston housing, and on which an extension piece that receives the dipping piston is mounted diametrically opposite the housing, where the inlet valve that is upline from the first pressure chamber is located in the connecting piece and comprises a ball placed in a flow-through cage, able to move against the force of a spring, and a valve seat in the form of a ring. In an alternative design, the pass-through for the piston rod is provided in an internal partition of the housing, and the transport line is formed in this area by cutouts made in the internal partition, preferably bored holes, running concentrically to the pass-through.

The inlet valve that is upline from the first pressure chamber of the differential piston may be formed simply by means of a sealing ring associated with the openings in the internal partition of the housing, and a pressure spring acting on it, braced against the housing.

In a simple design, the dipping piston is made of a disk positioned in the extension piece with radial play and having openings which are solidly attached to the piston rod, a stop provided on the piston rod at a distance from the disk, and a cover disk movably mounted between the stop and the disk, by which the openings in the disk may optionally be covered.

It is also advisable to attach the piston rod to the differential piston by using a connecting piece, through which fluid can flow, attached to the latter, and for the volume of the first pressure chamber of the differential piston to be about 1.2 to 2.5 times as large as the volume of the second pressure chamber.

Constructing a piston pump according to the invention guarantees that the flow delivered to the implement will not be interrupted, in spite of the reversals of the displacement motions of the differential piston; instead, the dipping piston and the design of the volumes and of the inlet valve positioned in the offset transport line ensure that the two pressure chambers are always completely filled with the medium that is to be processed. Due to the force of the spring acting on the movable part of the inlet valve which is not affected by the piston rod and the dipping piston, the inlet valve closes automatically as soon as there is no longer negative pressure in the first pressure chamber; as a result, backflow is no longer possible. The space vacated by the ejection of the medium to be processed from the second pressure chamber is thus immediately filled when the differential piston is moved in the direction of the inlet valve. Furthermore, because of the differently dimensioned effective faces of the differential piston, medium continues to be ejected. Therefore, there is no interruption of the transport stream, nor can air pockets form.

Thus, with minimal cost, the operating behavior of a differential piston pump working under high pressure is significantly improved; in addition, a long, problem-free operating life with simple maintenance is provided.

The drawing shows an exemplary embodiment of the differential piston pump constructed according to the invention, which is explained in detail below. The figures show the following, all in axial sectional views:

DETAILED DESCRIPTION

Figure 1:
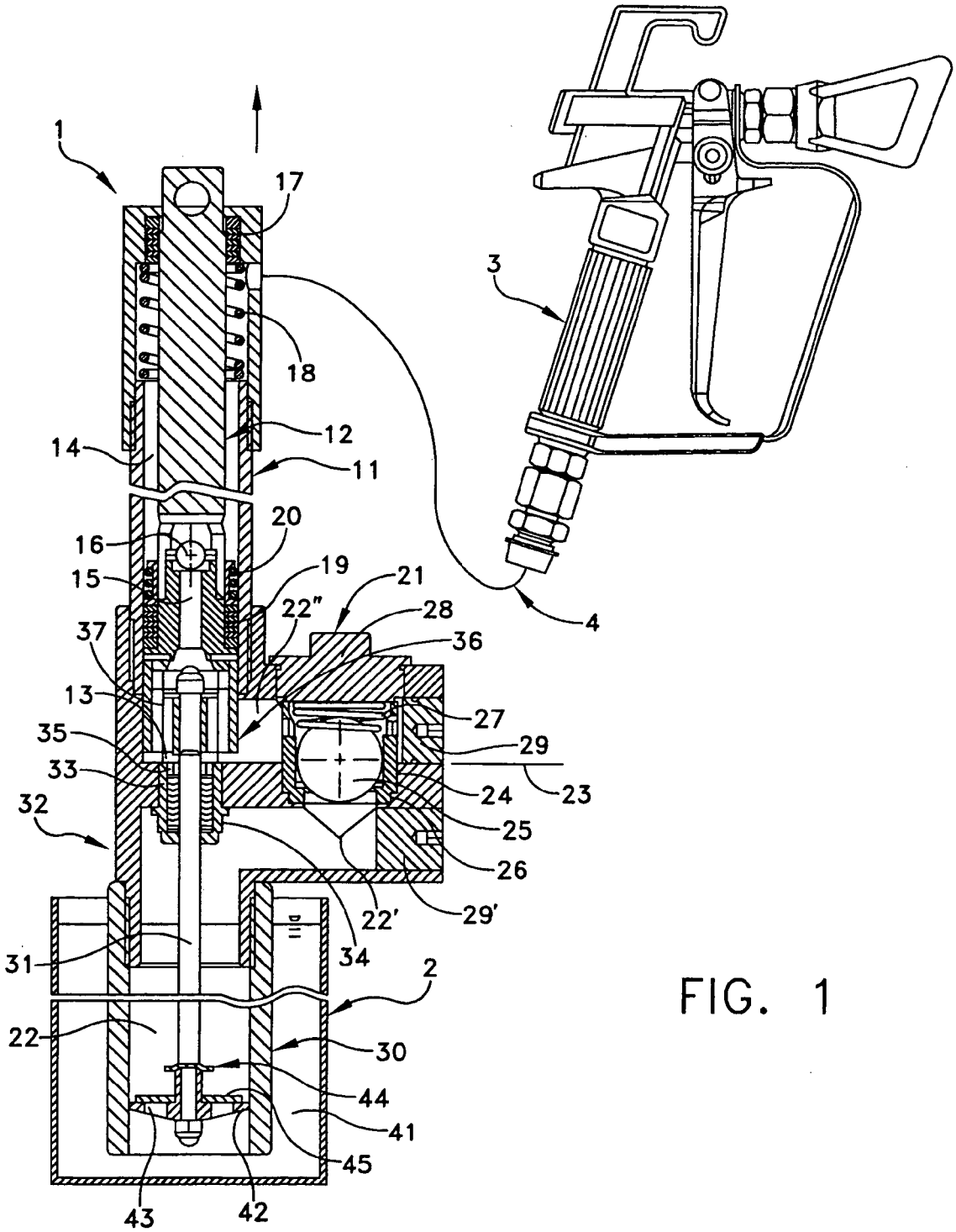
FIG. 1: the differential piston pump with attached spray gun as implement, at the beginning of an upward stroke of the differential piston.
Figure 2:
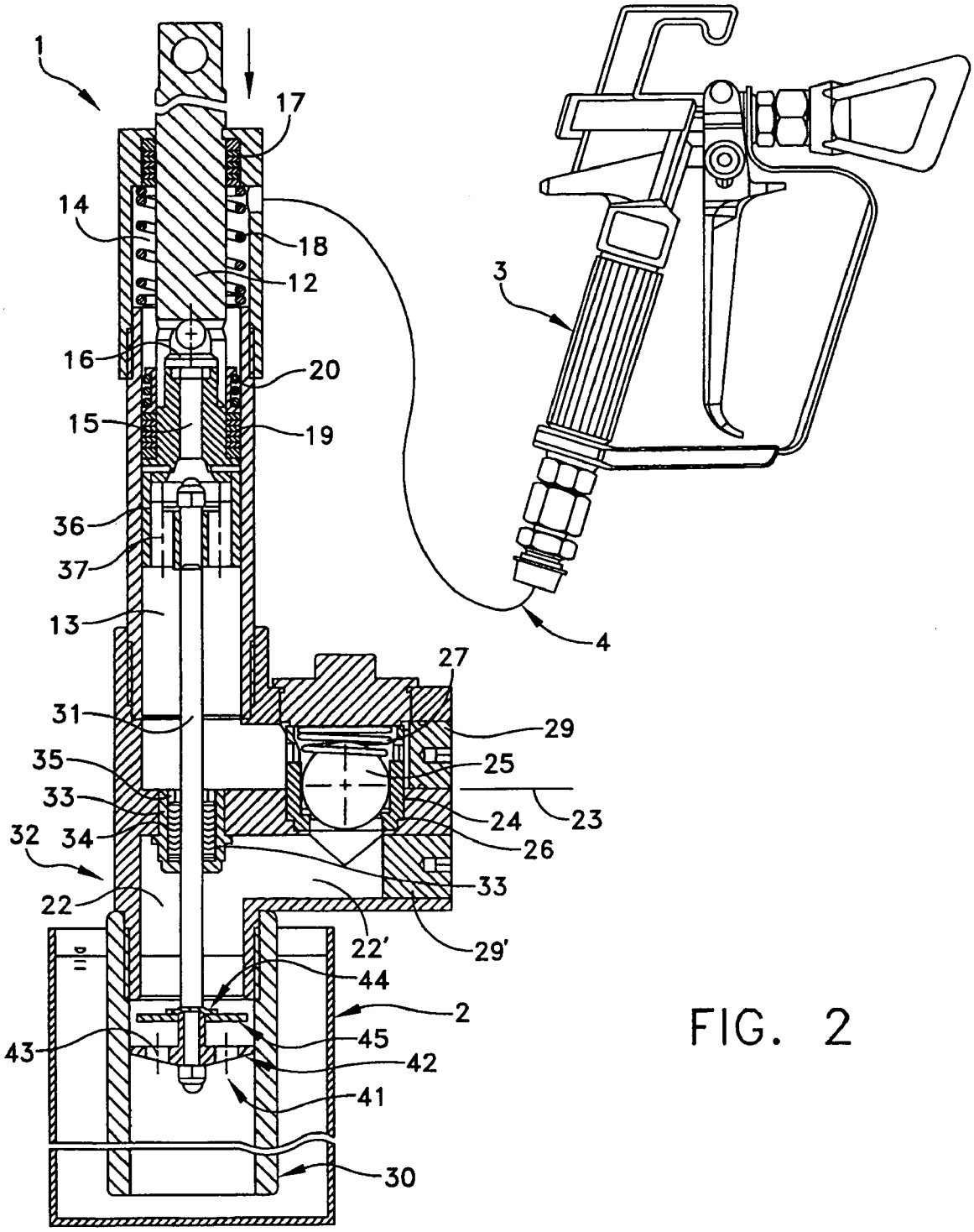
FIG. 2: the differential piston pump according to FIG. 1, after reversal of the displacement motion of the differential piston.

The differential piston pump shown in FIGS. 1 and 2, and designated in each case as 1, serves to transport a medium contained in a storage reservoir 2 to an implement in the form of a spray gun 3. In this case differential piston pump 1 is connected with spray gun 3 through a line 4, and consists of a differential piston 12 placed in a housing 11, whose first pressure chamber 13 is connected to second pressure chamber 14 through a connecting line 15, into which a check valve 16 is inserted. With the help of seals 17 under load from springs 18, second pressure chamber 14 is sealed toward the outside; with the help of additional seals 19, on which a spring 20 also acts, second pressure chamber 14 is sealed toward first pressure chamber 13.

The medium to be processed is fed to first pressure chamber 13 through a transport line 22, whose segments 22' and 22" are provided in a connecting piece 21. Connecting piece 21 is attached to housing 11 of differential piston 12, or housing 11 is screwed into connecting piece 21. Inserted into transport line 22 between segments 22' and 22" is an inlet valve 23, consisting of a valve body in the form of a ball 25, and a ring 26 as the valve seat. Ball 25 is held in a cage 24 formed by crossbars, and these are acted on by a spring 27 disposed in a plug 28 screwed into connecting piece 21. Segments 22' and 22" of transport line 22 are closed by additional plugs 29 and 29'.

Also mounted on connecting piece 21 is an extension piece 30, which makes up part of transport line 22, and in which a dipping piston 41 is positioned and axially movable. To accomplish this, a piston rod 31 is firmly connected with differential piston 12 by means of a connecting piece 36 through which fluid can flow, which is provided with openings 37 for that purpose. Pass-through 32 of piston rod 31 from first pressure chamber 13 of housing 11 into extension piece 30 is closed fluid-tight by means of a seal 34 disposed in a sleeve 33. To this end, a nut 35 screwed into connecting piece 21 acts on seal 34.

Dipping piston 41 has a disk 42 solidly connected to piston rod 31, which is inserted into extension piece 30 with radial play, and which is provided with openings 43. In addition, a stop 44 in the form of a ring is attached to piston rod 31 at a distance from disk 42, and positioned between stop 44 and disk 42 is a disk 45, which is movably mounted on piston rod 31 and by which the openings 43 of disk 42 may optionally be covered.

When differential piston pump 1 is started up, in accordance with the operating position shown in FIG. 1, with the help of dipping piston 41, which is immersed in the medium in storage reservoir 2, the medium above dipping piston 41 is raised, since the openings 43 of disk 42 are covered by disk 45, and is pressed through the opening inlet valve 23 into first pressure chamber 13 of differential piston 12. From there the medium flows with the first or second stroke through connecting line 15 into check valve 16, which also opens, and into second pressure chamber 14.

If the two pressure chambers 13 and 14 are filled with medium, spray gun 3 may be actuated in order to apply the medium to a part. During an upward stroke of differential piston 12, when spray gun 3 is open, the medium is transported out of second pressure chamber 14 into line 4 and thus to spray gun 3. Check valve 16 is closed at this time. At the same time, with inlet valve 23 open, medium is brought from storage reservoir 2 into first pressure chamber 13 by dipping piston 41.

On the other hand, when the displacement motion of differential piston 12 is reversed, and hence during a downward stroke, with inlet valve 23 closed and check valve 16 open, the medium that is in second pressure chamber 14 is pushed into line 4 and thus flows to spray gun 3. In addition, with inlet valve 23 closed medium flows from first pressure chamber 13 into second pressure chamber 14, so that the latter becomes filled and transporting is ensured without interruption, in spite of the translational displacement motions of differential piston 12. Accordingly, spray gun 3 is continuously supplied with the medium to be processed.

The volumes of the two pressure chambers 13 and 14 here are matched to each other in such a way, for example in the proportions 2:1, that second pressure chamber 14 is guaranteed to always be filled. Surplus medium can always flow back into storage reservoir 2 during both displacement motions of dipping piston 41, since the latter's disk 42 is inserted into extension piece 30 with radial play and has a number of openings 43.

If first pressure chamber 13 and segment 22' of transport line 22 are filled with medium, but the upward motion of the dipping piston is not yet finished, the medium flows back into storage reservoir 2 because of the radial play of dipping piston 41; during the downward motion dipping piston 41 can readily dip into the medium in storage reservoir 2, since disk 45 is raised off of disk 42.

Figure 3:
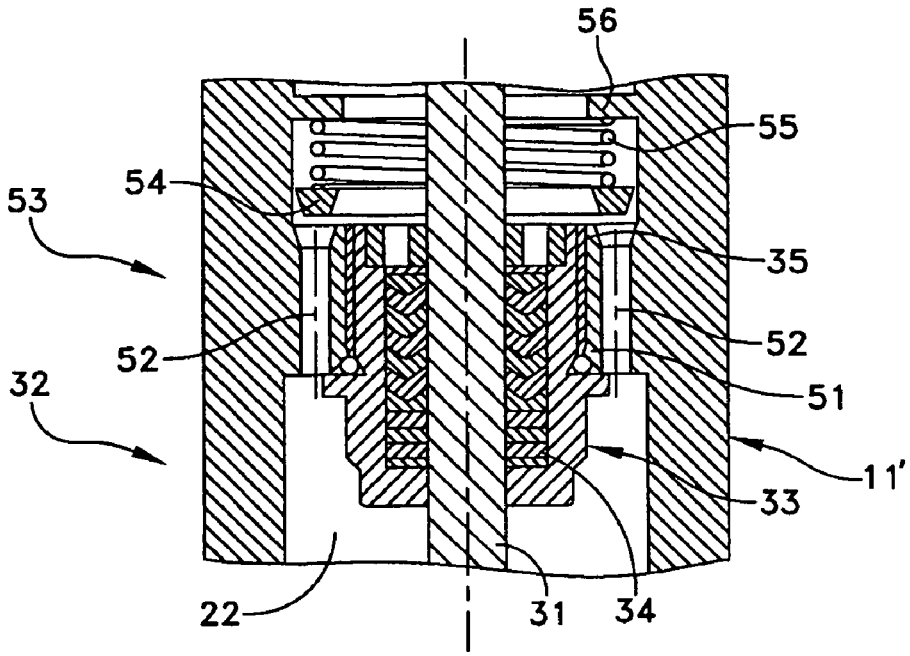
FIG. 3: an alternative design of the transport line fitted with an inlet valve, in the operating position according to FIG. 1.
Figure 4:
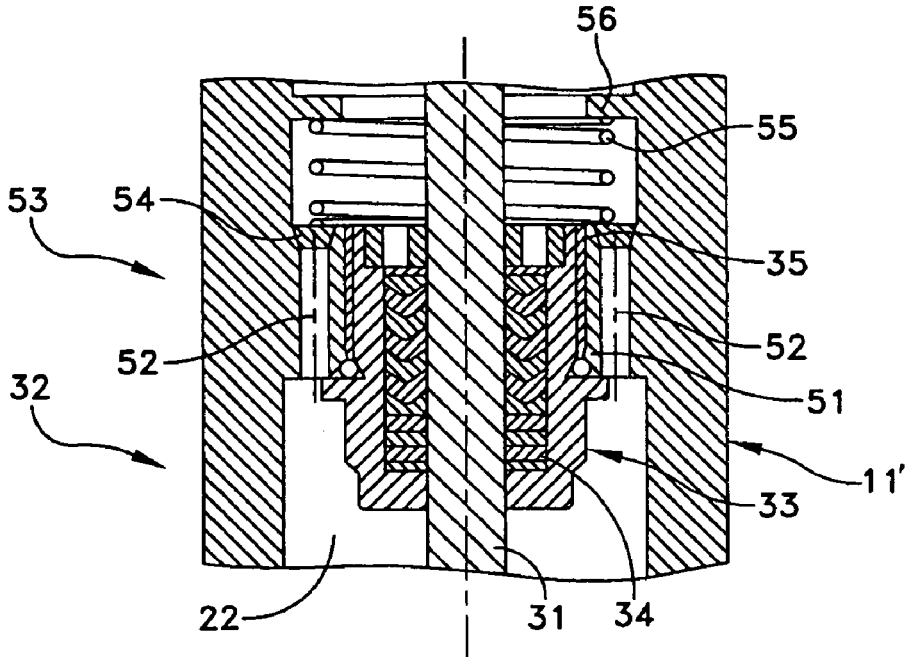
FIG. 4: the alternative transport line fitted with the inlet valve of FIG. 3, in the operating position according to FIG. 2.

In the variant embodiments portrayed in FIGS. 3 and 4, transport line 22 is arranged concentrically to pass-through 32 of piston rod 31. To this end, housing 11' is provided with an internal partition 51, in which the seals 34 and the nuts 35 that act on them are held or supported by sleeve 33, which is screwed into it. In addition, a number of openings 52 in the form of bored holes are made in the internal partition 51 concentric to pass-through 32; these produce the connection of transport line 22 with first pressure chamber 13.

To seal openings 52, an inlet valve 53 is provided, which consists in this case of a sealing ring 54 and a pressure spring 55 acting on it, which is braced against a projection 56 that protrudes inward from housing 11'. In FIG. 3, which corresponds to the operating position of differential pump 1 according to FIG. 1, inlet valve 53 is open. In FIG. 4, in contrast, inlet valve 53 is closed in accordance with the operating position according to FIG. 2.

The invention claimed is:

1. A piston pump for transporting highly viscous media from a storage reservoir to a spray gun, the pump having a differential piston positioned in a cylindrical housing and translationally drivable, the pump having a first pressure chamber connected to a second pressure chamber via a connecting line having a check valve therein, the pump further being connected with a storage reservoir via an inlet valve, wherein the differential piston is provided with a dipping piston that dips into the medium to be transported, the dipping piston being attached to an aligned piston rod, wherein a pass-through of the piston rod from the first pressure chamber is closed fluid-tight by at least one seal, and wherein a transport line is disposed in the vicinity of the pass-through of the piston rod;

wherein the pass-through of the piston rod is provided with at least a portion of said transport line provided in a connecting piece connected with the housing of said differential piston, and wherein an extension piece receives the dipping piston and is attached to the connecting piece;

wherein the inlet valve is located upline from the first pressure chamber; and wherein the first pressure chamber is in the connecting piece.

2. The piston pump in accordance with claim 1, wherein said transport line is positioned, at least in part, concentric to the piston rod.

3. The piston pump in accordance with claim 1, wherein said transport line is, at least in part, laterally offset from the piston rod.

4. The piston pump in accordance with claim 1 wherein the inlet valve includes a ball disposed in a cage through which fluid can flow and wherein the ball is urged by a spring towards a valve seat.

5. The piston pump in accordance with claim 1, wherein the piston rod is attached to the differential piston by a connecting piece through which fluid can flow and which is attached to said differential piston.

6. The piston pump in accordance with claim 1, wherein the first pressure chamber is provided with a volume of about 1.2 to 2.5 times a volume of the second pressure chamber.

7. A piston pump for transporting highly viscous media from a storage reservoir to a spray gun, the pump having a differential piston positioned in a cylindrical housing and translationally drivable, the pump having a first pressure chamber connected to a second pressure chamber via a connecting line having a check valve therein, the pump further being connected with a storage reservoir via an inlet valve, wherein the differential piston is provided with a dipping piston that dips into the medium to be transported, the dipping piston being attached to an aligned piston rod, wherein a pass-through of the piston rod from the first pressure chamber is closed fluid-tight by at least one seal, and wherein a transport line is disposed in the vicinity of the pass-through of the piston rod;

and wherein the pass-through of the piston rod is provided in an internal partition of the housing, and said transport line is formed by a plurality of openings in the internal partition, located concentric to the pass-through.

8. The piston pump in accordance with claim 7, wherein the inlet valve is formed by a sealing ring associated with the openings in the internal partition of the housing, and a pressure spring acting between the ring and the housing.

9. A piston pump for transporting highly viscous media from a storage reservoir to a spray gun, the pump having a differential piston positioned in a cylindrical housing and translationally drivable, the pump having a first pressure chamber connected to a second pressure chamber via a connecting line having a check valve therein, the pump further being connected with a storage reservoir via an inlet valve, wherein the differential piston is provided with a dipping piston that dips into the medium to be transported, the dipping piston being attached to an aligned piston rod, wherein a pass-through of the piston rod from the first pressure chamber is closed fluid-tight by at least one seal, and wherein a transport line is disposed in the vicinity of the pass-through of the piston rod;

wherein the dipping piston includes:

a. a disk having openings therein and positioned in the extension piece and attached to the piston rod, b. a stop provided on the piston rod at a selected distance from the disk, and c. a cover mounted on the piston rod and movable between the stop and the disk, such that the openings provided in the disk are closed when the cover is proximate the disk and the openings are open when the cover is distal of the disk.

10. The piston pump in accordance with claim 9, wherein the disk exhibits radial play with respect to the extension piece.

* * * * *